US006067759A

United States Patent [19]

House

[11] Patent Number: 6,067,759

[45] Date of Patent: May 30, 2000

[54] ROOF CURB STRUCTURES AND METHODS OF MANUFACTURE

[75] Inventor: Robert M. House, Nixa, Mo.

[73] Assignee: Loren Cook Company, Springfield, Mo.

[21] Appl. No.: 09/070,114

[22] Filed: Apr. 29, 1998

[51] Int. Cl.[7] ..... E04B 7/18; E04D 13/14

[52] U.S. Cl. ..... 52/198; 52/200; 52/219; 52/656.2; 52/658; 52/745.19; 52/58

[58] Field of Search ..... 52/19, 198, 200, 52/218, 219, 656.6, 658, 656.2, 745.19, 58; 29/897.3, 897.31

[56] References Cited

U.S. PATENT DOCUMENTS

| | | | |
|---|---|---|---|
| 2,126,544 | 8/1938 | Everhard | 52/658 |
| 3,363,369 | 1/1968 | Miller | 52/219 X |
| 4,635,409 | 1/1987 | Vandemore | 52/219 X |
| 5,016,406 | 5/1991 | Calam et al. | 52/200 X |
| 5,553,425 | 9/1996 | Sampson et al. | 52/198 X |
| 5,687,514 | 11/1997 | Gillispie | 52/200 X |
| 5,806,255 | 9/1998 | Verby et al. | 52/200 |

OTHER PUBLICATIONS

RPS–Roof Curbs dated Apr. 1994 (8 pages).
AES Industries Roof Curbs brochure—undated (5 pages).

*Primary Examiner*—Christopher T. Kent

*Attorney, Agent, or Firm*—Renner, Otto, Boisselle & Sklar, LLP

[57] ABSTRACT

Roof curb structures include side shells made by cutting a series of transversely aligned V-shaped notches and straight slots along top and bottom edges of a continuous length of sheet metal strip material at spaced apart intervals corresponding to the length of each side of the side shells to be formed therefrom. Then the strip material is cut to length corresponding to the length of one, two or four sides of the side shells and the top and bottom edges are roll formed in opposite directions to form oppositely extending top and bottom flanges. Next the severed lengths of strip material are folded at each transversely aligned intermediate notch and slot (if the length is greater than the length of one of the sides) to form continuous right angle corners at such intermediate notches and slots, and the ends of such strip material are either seam welded together or the ends of additional lengths of strip material are fitted and seam welded together to form box-like shells having inturned top flanges and outturned bottom flanges. Then the outturned bottom flanges of the shells are positioned against four identical bottom strips that extend a substantial portion of the length of the outturned bottom flanges and beyond one end into underlying relation to an end of the next adjacent outturned bottom flange, and the outturned bottom flanges and the next adjacent outturned bottom flange are spot welded to the same bottom strips to form rigid bottom supports for the shells.

24 Claims, 7 Drawing Sheets

ROOF CURB STRUCTURES AND METHODS OF MANUFACTURE

FIELD OF THE INVENTION

This invention generally relates to roof curb structures for mounting ventilators on the roof penetrations of buildings and methods of making same.

BACKGROUND OF THE INVENTION

Roof curbs are commonly used for mounting ventilators on roof penetrations of buildings. However, existing roof curbs are relatively expensive to manufacture and difficult to make square and precise for dimensional stability because of the relatively large number of parts that comprise the roof curbs including particularly the side shell and curb bottom. As an example, one such existing side shell and curb bottom is made out of a total of twenty different pieces.

SUMMARY OF THE INVENTION

The roof curb structures of the present invention including particularly the side shells and curb bottom consist of substantially fewer parts than previous known roof curb structures, making them less expensive to manufacture and easier to make square and precise for greater stability and dimensional uniformity.

In accordance with one aspect of the invention, the side shell and bottom of the roof curb structure for most sizes (for example up to 40 inches long on a side) consists of a total of four pieces, e.g., a one piece side shell having a single weld seam and a bottom made out of four identical (and thus interchangeable) pieces.

In accordance with another aspect of the invention, the side shells and bottoms for larger size roof curbs (for example, exceeding 40 or 80 inches on a side) consist of a total of six or eight pieces, e.g., a two or four piece side shell having two or four weld seams, respectively, and a four piece bottom.

In accordance with another aspect of the invention, an optional damper tray consisting of four identical (and thus interchangeable) pieces is provided for the roof curbs.

In accordance with another aspect of the invention, the roof curb structures include a simple and effective means of mounting insulation on the interior surface of the side shells.

In accordance with another aspect of the invention, an efficient, cost effective method is provided for making the side shells for such roof curb structures from a continuous length of sheet metal strip material with a minimum amount of cutting, forming and welding.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
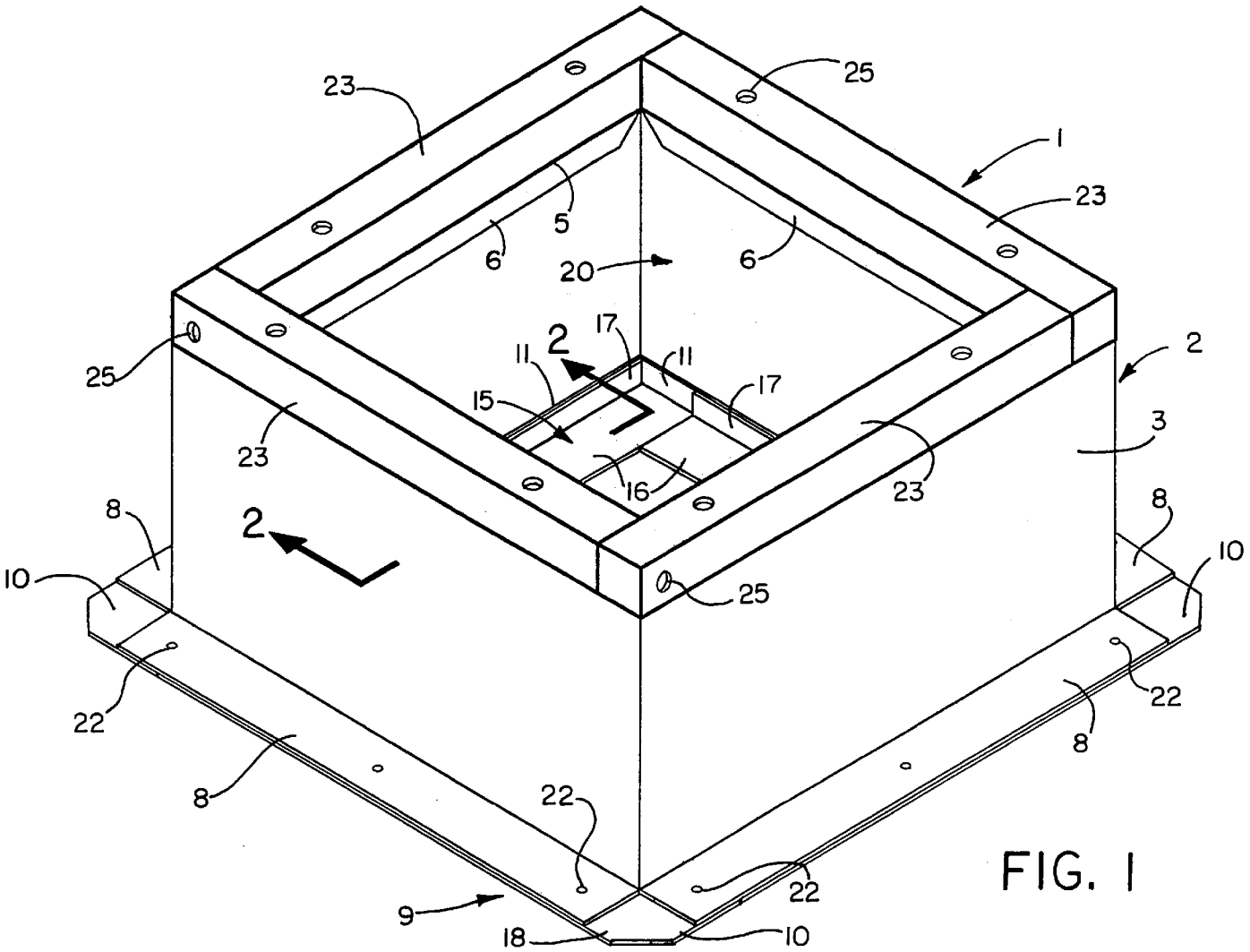
FIG. 1 is a perspective view of a preferred form of roof curb structure made in accordance with the present invention.
Figure 2:
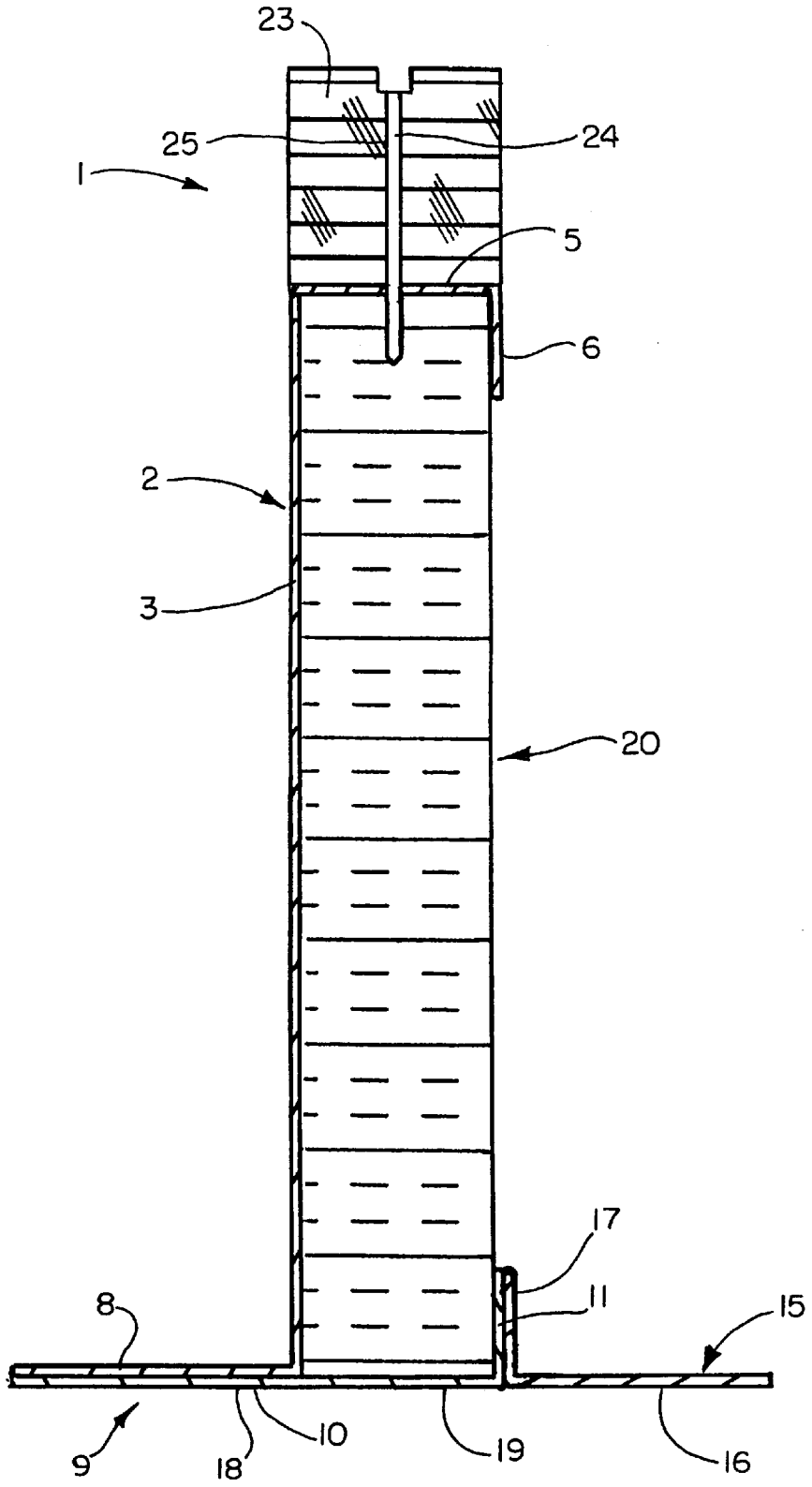
FIG. 2 is an enlarged transverse section through one side of the roof curb structure of FIG. 1 taken generally along the plane of the line 2—2 thereof.

Referring now in detail to the drawings, and initially to FIGS. 1 and 2, there is shown a preferred form of roof curb structure 1 in accordance with the present invention including a box-like side shell 2 having four sides 3 made out of a suitable sheet metal such as galvanized steel of the required thickness (18 gauge being typical). The length and height of the sides 3 may vary depending on the size of roof curb structure required for a particular application. Extending inwardly from the top edge of each side 3 is a top flange 5 (see FIG. 2). At the inner edge of the top flange 5 is a downturned lip 6 for added rigidity and to help support and retain insulation against the interior surface of the side shell 2 as described hereafter.

Figure 3:
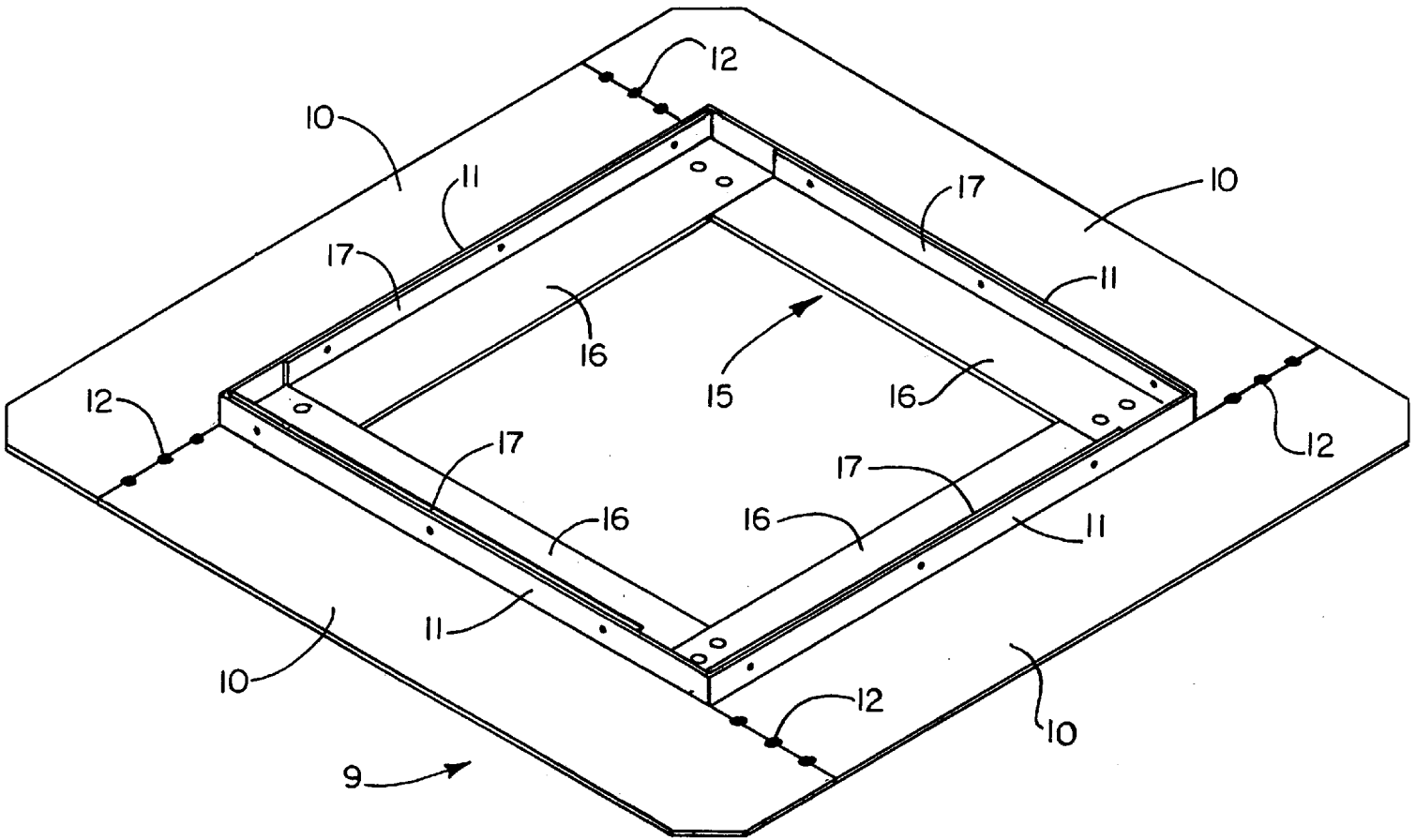
FIG. 3 is a perspective view of the curb bottom and optional damper tray shown in FIG. 1.

Extending outwardly from the bottom edge of each side 3 is a bottom flange 8. Attached to the bottom flange 8 is a bottom subassembly 9 which as best seen in FIG. 3, consists of four identical (and thus interchangeable) sheet metal strips 10 each having an upturned lip 11 extending along the inner edge from one end toward the other end. The upturned lips 11 have a length substantially corresponding to the length of the downturned lips 6 of the side shell 2, whereas the bottom strips 10 have a length substantially equal to the length of the bottom flanges 8. This permits the four bottom strips 10 to be fitted together in box-like fashion with the ends of the upturned lips 11 butted up against each other and the protruding length of each bottom strip butted up against the end of the next adjacent bottom strip and secured together as by tack welds 12 as shown in FIG. 3.

Figure 3A:
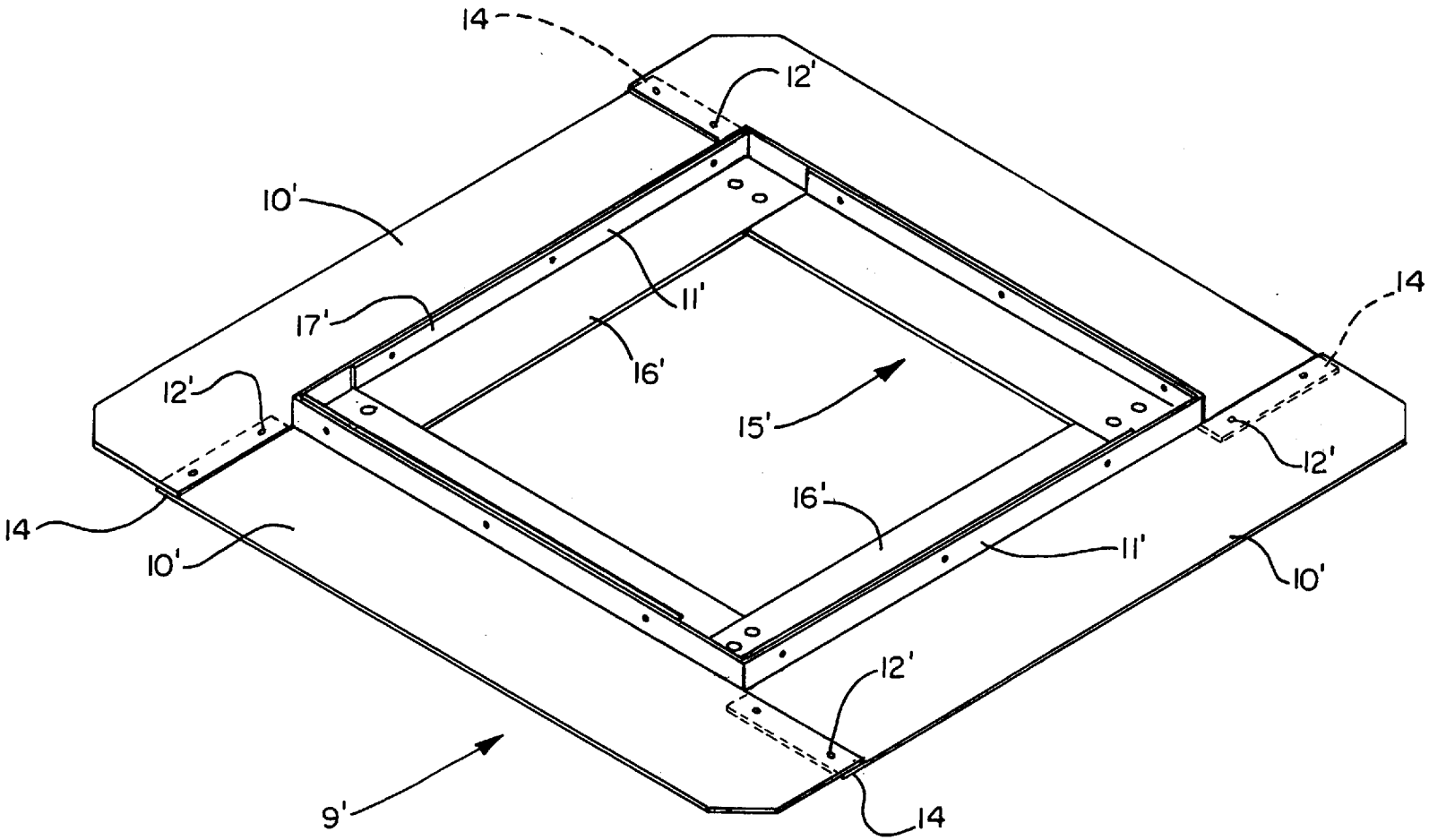
FIG. 3A is a perspective view of a modified form of curb bottom in accordance with this invention.

Alternatively, the ends 14 of the bottom strips 10' may also be made to extend a short distance beyond the associated lip 11' into underlying relation with the end of the next adjacent bottom strip so that the overlapping ends may be secured together as by spot welds 12' as shown in FIG. 3A. Otherwise, the bottom subassembly 9' shown in FIG. 3A is substantially the same as the bottom subassembly 9 shown in FIG. 3, and the same reference numerals followed by prime symbols are used to designate like parts.

Also, if desired, a damper tray 15 made of four identical (and thus interchangeable) sheet metal strips 16 may optionally be mounted within the opening defined by the four upturned lips 11 of the bottom strips 10 for attaching a back draft damper (not shown) to the roof curb to keep air from blowing back into the building through the roof penetration when the ventilator is turned off. As best seen in FIG. 3, each damper tray strip 16 has a length substantially equal to the interior spacing between opposed upturned lips 11 on the bottom strips 10 less the width of the damper tray strips 16. This allows the damper tray strips 16 to be fitted within the box-like opening defined by the upturned lips 11 of the bottom strips 10, with one end of each damper tray strip 16 pressed up against a respective upturned lip 11 at each corner and the other end of each damper tray strip butting up against an inner edge of the next adjacent damper tray strip. Extending along the outer edge of each damper tray strip 16 is an upturned lip 17 that is pressed up against an adjacent upturned lip 11 of the bottom strips 10 for securing the damper tray strips 16 to the bottom strips 10 as by spot welding the respective upturned lips 17 and 11 together at spaced apart intervals along the length thereof.

Referring further to FIGS. 1 and 2, the bottom strips 10 have outer portions 18 that underlie the outturned bottom flanges 8 of the side shell 2 and inner portions 19 extending inwardly of the sides 3 of the side shell 2 in vertically spaced relation to the inturned top flanges 5 of the side shell with the upturned lips 11 on the inner edges of the bottom strips 10 in substantial vertical alignment with the downturned lips 6 on the inner edges of the inturned top flanges 5. This facilitates easy positioning of a continuous strip of insulation 20 around the inner periphery of the shell 2 between the inturned top flanges 5 and inner portions 19 of the bottom strips 10 and retention therebetween by the downturned and upturned lips 6 and 11 as shown in FIG. 2.

The outturned bottom flanges 8 of the shell sides 3 have squared off ends (see FIG. 1). Also, the bottom strips 10 have a length substantially equal to (or slightly greater than) the length of the outturned bottom flanges 8 as aforesaid. Thus, when the outer portions 18 of the bottom strips 10 are placed in underlying relation to the outturned bottom flanges 8 with their outer edges in substantial alignment with each other and the upturned lips 11 on the bottom strips 10 oriented symmetrically within the interior of the side shell 2 in substantial vertical alignment with the downturned lips 6 of the side shell, the bottom strips 10 will extend a substantial portion of the length of the outturned bottom flanges and beyond one end with their protruding portions 18 in underlying relation to the ends of the next adjacent outturned bottom flanges. This has the advantage that when the outturned bottom flanges 8 are spot welded to the bottom strips 10 at spaced apart intervals along the lengths thereof, the spot welds 22 adjacent the corners will secure the ends of adjacent outturned bottom flanges to the same bottom strips adjacent the corners to tie the shell sides 3 together at each corner to provide a more rigid, straight sided profile for the side shell.

Extending along the inturned top flanges 5 of the side shell 2 are wood nailers 23 which may be secured in place as by driving spiral shank nails 24 through the tops of the wood nailers into the inturned top flanges as shown in FIG. 2 and in the sides of the wood nailers adjacent one end as shown in FIG. 1 into the end of the next adjacent wood nailer.

Figure 4:
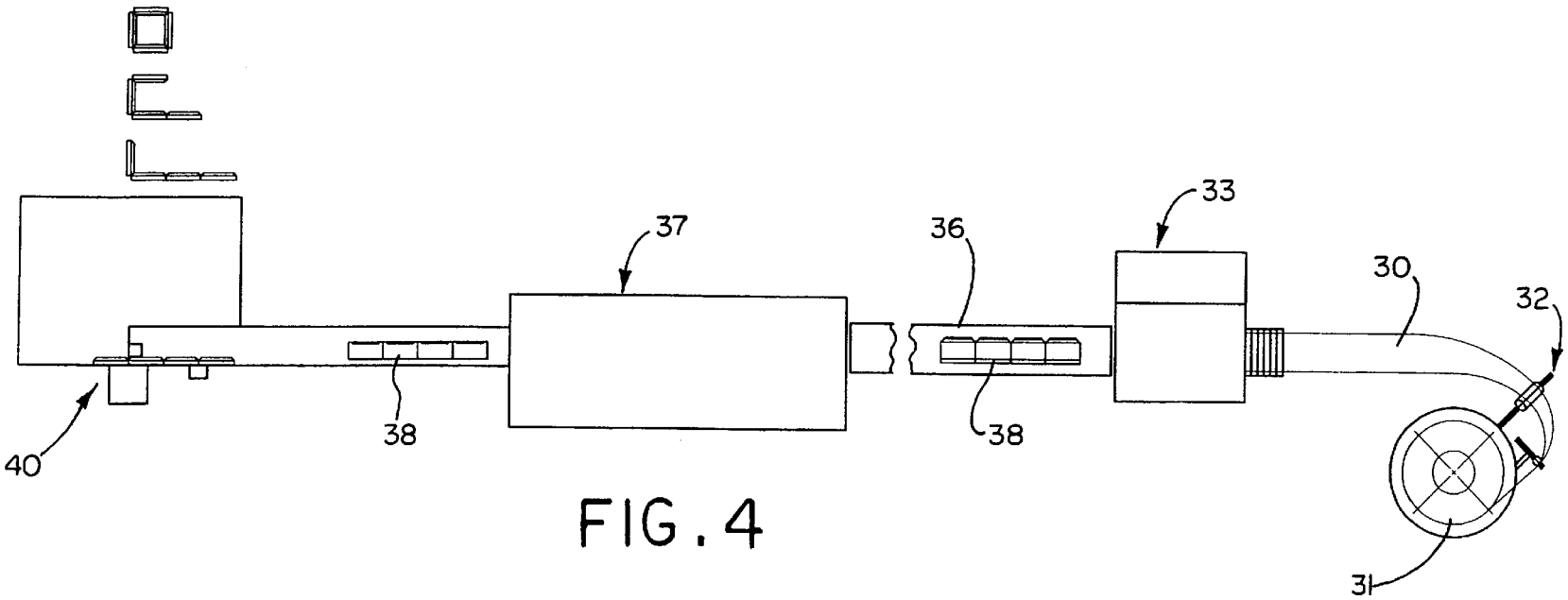
FIG. 4 is a schematic view showing the sequence of manufacturing the side shells for the roof curbs of the present invention.
Figure 5:
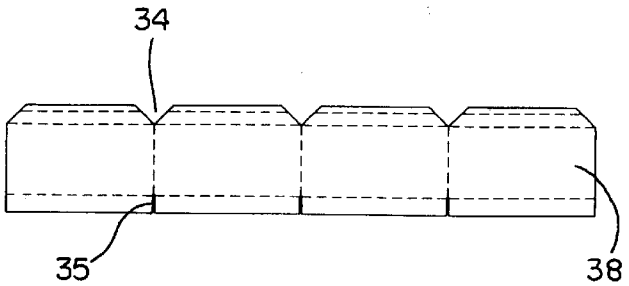
FIG. 5 is an enlarged side elevation view of a length of the strip material shown in FIG. 4 after the top and bottom edges have been notched and slit and cut to length.
Figure 7:
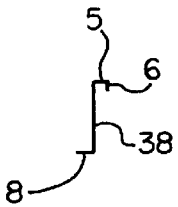
FIG. 7 is an end elevation view of the edge roll formed strip of FIG. 6 as seen from the right end thereof.
Figure 6:
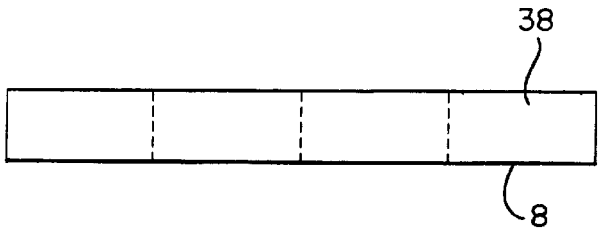
FIG. 6 is a side elevation view of the length of strip material shown in FIG. 5 after the top and bottom edges have been roll formed.

FIG. 4 schematically shows a preferred sequence of manufacturing the side shells 2 for the roof curbs 1 of the present invention from a continuous length of sheet metal strip material 30 with a minimum amount of cutting, forming and welding. First a supply coil 31 of the strip material 30 is fed from a decoiler 32 which pays out the strip material. Then the strip material is fed through a notching mechanism 33 that cuts transversely aligned V-shaped notches 34 and straight slots 35 in the top and bottom edges of the strip material as shown in FIG. 5 after each indexing movement of the strip material which corresponds to the length of each side of the side shells to be formed from the strip material. Next the strip material 30 is cut to length and conveyed by a feed conveyor 36 to a roll former 37 that roll forms the top and bottom edges of each severed length of strip material in opposite directions at the full depth of the notches 34 and slots 35 to form the top and bottom flanges 5 and 8 along the top and bottom edges as well as the downturned lips 6 along the inner edges of the top flanges 5 as schematically shown in FIGS. 6 and 7. Then the severed length 38 of strip material 30 is conveyed to a tangent former 40 where the severed length of strip material is sequentially folded (e.g., formed) along the center of each transversely aligned notch 34 and slot 35 intermediate the ends of each severed length of strip material in the direction of the top flanges 5 to form continuous right angle corners 41 with the adjacent edges 42, 43 of the top flanges 5 in abutting engagement with each other as schematically shown in FIGS. 8 through 11.

Figure 13:
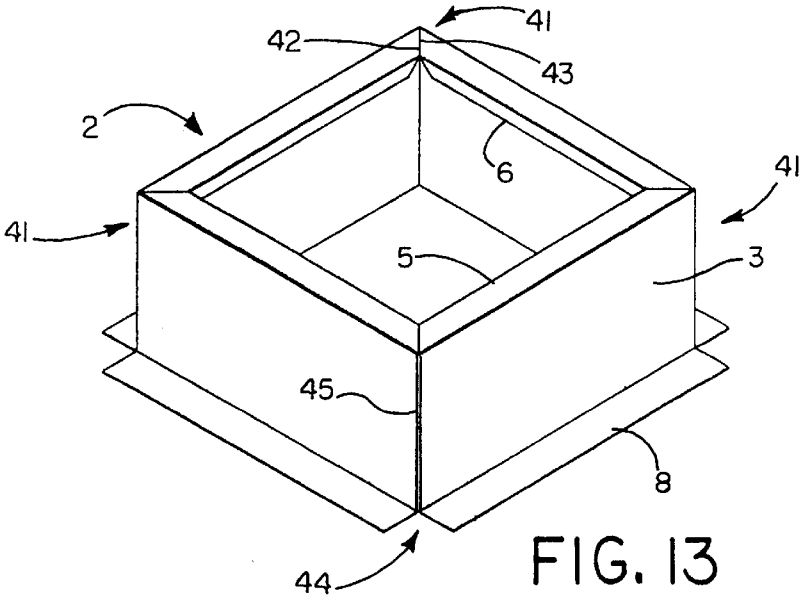
FIG. 13 is a perspective view of a side shell formed from the severed length of strip material shown in FIG. 12 which includes three continuous right angle corners and one seam welded corner.
Figure 12:
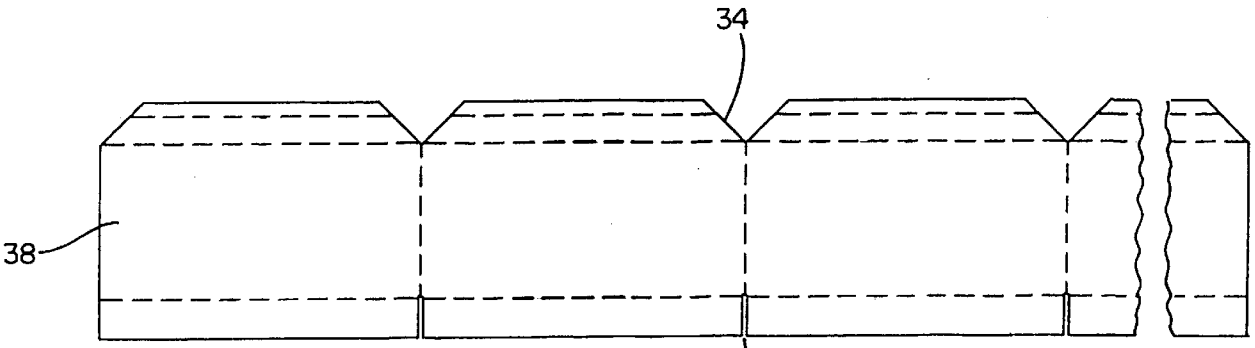
FIG. 12 is an enlarged fragmentary side elevation view of a severed length of strip material similar to FIG. 5 having an overall length corresponding to the total length of all four sides of a side shell to be formed therefrom.
Figure 8:
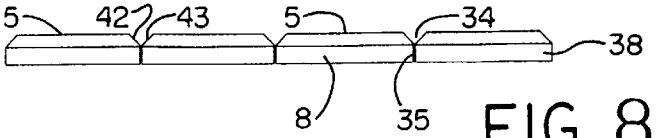
FIG. 8 is a top plan view of the edge roll formed strip material of FIG. 6.
Figure 9:
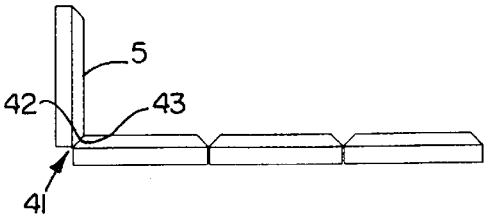
FIGS. 9 through 11 are top plan views of the strip material of FIG. 8, but showing how the strip material is progressively folded into a box shape having three continuous right angle corners and one non-continuous right angle corner.
Figure 10:
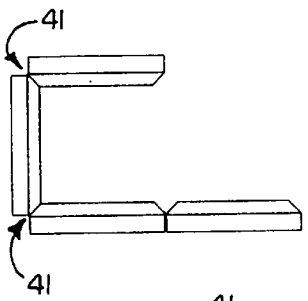
Figure 11:
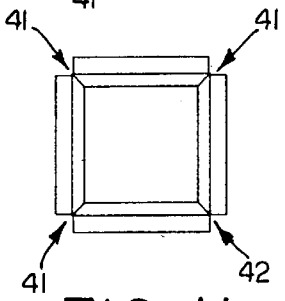

Depending on the required length of each side 3 of the side shells 2 and the length of the feed conveyor 36, the strip material is desirably cut to a length corresponding to the length of all four sides as shown in FIGS. 5 and 12. In that event, after the top and bottom edges have been roll formed as previously described, the tangent former 40 will progressively fold the strip material three times as schematically shown in FIGS. 9 through 11 to form a box shape side shell 2 having three continuous right angle corners 41 and one non-continuous right angle corner 44 which requires one seam weld 45 at the non-continuous corner, as schematically shown in FIG. 13.

Figure 14:
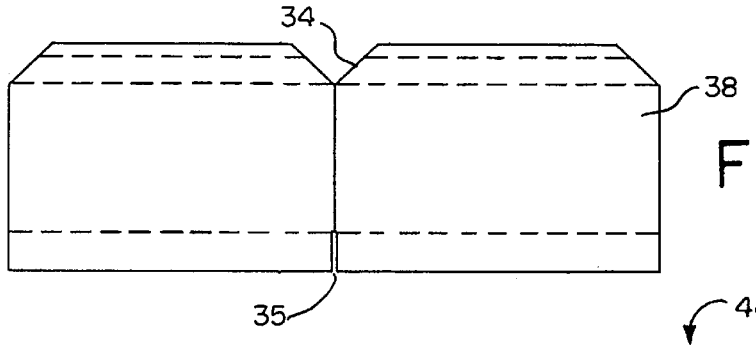
FIG. 14 is an enlarged side elevation view of a severed length of strip material having an overall length corresponding to the length of two sides of a side shell to be formed therefrom.
Figure 15:
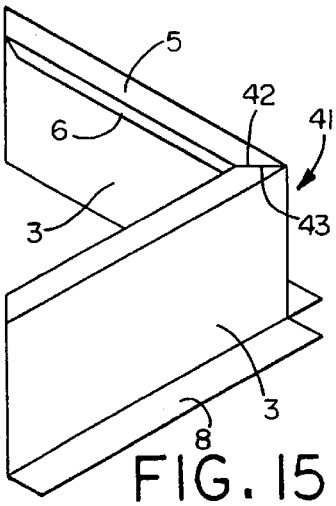
FIG. 15 is a perspective view of the two sides formed from the severed length of strip material of FIG. 14 which includes one continuous right angle corner.
Figure 16:
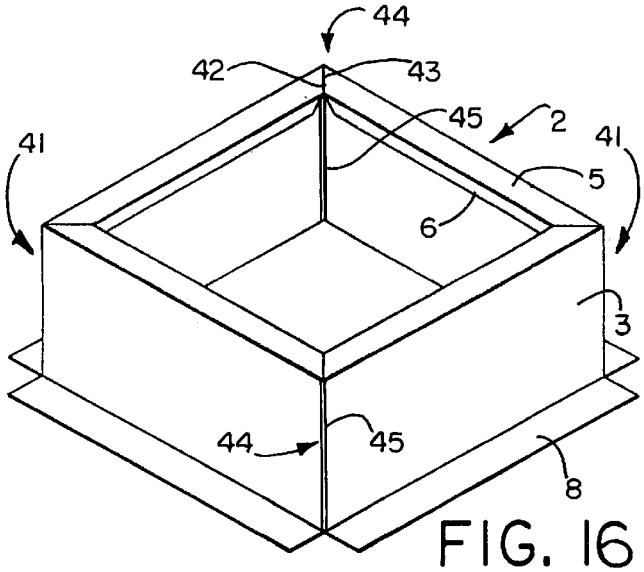
FIG. 16 is a perspective view of a side shell made from two of the side shell halves of FIG. 15 which includes two continuous right angle corners and two seam welded right angle corners.
Figure 17:
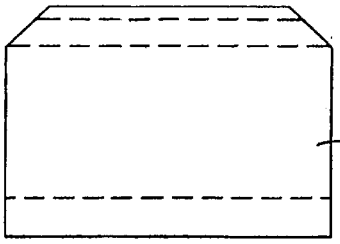
FIG. 17 is an enlarged side elevation view of a severed length of strip material having an overall length corresponding to the length of one side of a side shell to be formed therefrom.
Figure 18:
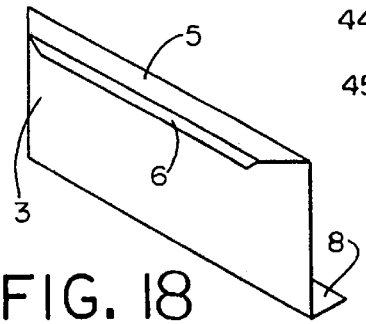
FIG. 18 is a perspective view of one side of a side shell formed from the severed length of strip material of FIG. 17.
Figure 19:
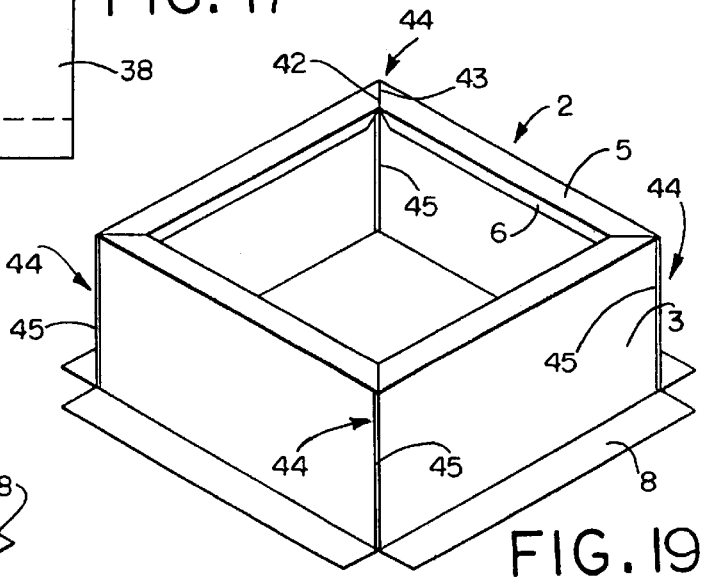
FIG. 19 is a perspective view of a side shell made from four of the sides of FIG. 18 which includes four seam welded right angle corners.

For the larger size side shells, the feed conveyor 36 may not be able to handle a length of strip material corresponding to the length of all four sides of the side shells. Where the length of the sides 3 of the side shells 2 is such that the feed conveyor 36 can only handle a length of strip material corresponding to the length of two sides of the side shells, the strip material is cut to length corresponding to the length of two of the sides as schematically shown in FIG. 14. After the top and bottom edges have been roll formed, the strip is folded at the aligned intermediate notch 34 and slot 35 in the direction of the top flanges 5 to bring the edges 42, 43 of the intermediate notch 34 into abutting engagement with each other to form two sides 3 with one continuous right angle corner 41 as shown in FIG. 15. Then two such folded lengths of strip material are fitted together to form a side shell 2 having two continuous right angle corners 41 and two non-continuous right angle corners 44 which must be seam welded together as schematically shown in FIG. 16.

Where the length of the sides of the side shells is such that the feed conveyor 36 can only handle a length of strip material corresponding to the length of one side of the side shells, the strip material is cut to length corresponding to the length of one side as schematically shown in FIG. 17. Then, after the top and bottom edges have been roll formed as shown in FIG. 18, opposite ends of four such sides 3 are fitted together with the top flanges 5 extending inwardly and the bottom flanges 8 extending outwardly to form a side shell 2 having four non-continuous right angle corners 44 that must be seam welded together as schematically shown in FIG. 19.

If for example the feed conveyor 36 is of a size that can only handle a total length of strip material up to 160 inches, as long as the length of each side of the side shell is no more than 40 inches, the side shells can be made out of a single piece of strip material that is folded three times to form a one-piece side shell having three continuous right angle corners and just one non-continuous right angle corner that must be seam welded together. If the length of each side is greater than 40 inches but less than 80 inches, each side shell will have to be made in two pieces each including two sides and one continuous right angle corner, and such pieces will have to be seam welded together at opposite corners. However, if the length of each side is greater than 80 inches, each side shell will have to be made out of four separate pieces each having a length corresponding to the length of one side of the shell and seam welded together at all four corners. As previously indicated, FIG. 13 shows a one piece side shell with one seam weld; FIG. 16 shows a two piece side shell with two seam welds; and FIG. 19 shows a four piece side shell with four seam welds.

Of course, the feed conveyor equipment could be made large enough to be able to handle strips longer than 160 inches, in which event at least one and possibly all three continuous corners of the larger size side shells could be roll formed in each strip to minimize the number of seam welds required to make the side shells.

Although the invention has been shown and described with respect to certain preferred embodiments, it is obvious that equivalent alterations and modifications will occur to others skilled in the art upon the reading and understanding of the specification. The present invention includes all such alterations and modifications, and is limited only by the scope of the claims.

What is claimed is:

1. A roof curb structure for mounting a ventilator on a roof penetration of a building comprising a sheet metal shell having a generally box-like shape including four sides having outturned bottom flanges, and a bottom support comprised of four sheet metal bottom strips underlying a substantial portion of the length of said bottom flanges and protruding beyond one end of said bottom flanges into underlying relation to an end of the next adjacent bottom flange, said bottom flanges and the end of the next adjacent bottom flange being secured to the same bottom strips.

2. The roof curb structure of claim 1 wherein said outturned bottom flanges and said bottom strips are welded together.

3. The roof curb structure of claim 1 wherein said sides have inturned top flanges with beveled ends that butt up against the ends of adjacent inturned top flanges.

4. The roof curb structure of claim 3 wherein innermost edges of said inturned top flanges have downturned lips in substantial vertical alignment with upturned lips on innermost edges of said bottom strips.

5. The roof curb structure of claim 4 wherein said upturned lips on said bottom strips have a length substantially corresponding to the length of said downturned lips.

6. The roof curb structure of claim 1 wherein said bottom flanges have squared off ends, and said bottom strips have a length substantially equal to or greater than the length of said bottom flanges.

7. The roof curb structure of claim 6 wherein the protruding portions of said bottom strips are butted up against or overlie the ends of the next adjacent bottom strips.

8. The roof curb structure of claim 1 wherein said shell consists of a single piece of sheet metal having four continuous sides interconnected by three continuous corners and one seam welded corner.

9. The roof curb structure of claim 1 wherein said shell consists of two separate pieces of sheet metal, each having two continuous sides interconnected by continuous corners and two seam welded corners.

10. The roof curb structure of claim 1 wherein said shell consists of four separate pieces of sheet metal each forming a side of said shell, said sides being joined together at their ends by four seam welded corners.

11. The roof curb structure of claim 1 further comprising a damper tray consisting of four damper tray strips each having a length substantially equal to the interior spacing between opposed upturned lips on said bottom strips less the width of said damper tray strips, said damper tray strips having upturned lips along outer edges of said damper tray strips in mating engagement with said upturned lips on said bottom strips, said damper tray strips having one end in abutting engagement with said upturned lips on said bottom strips, and an other end butting up against an inner edge of the next adjacent damper tray strip, said upturned lips on said damper tray strips being secured to said upturned lips on said bottom strips.

12. The roof curb structure of claim 11 wherein said upturned lips on said damper tray strips and said bottom strips are spot welded together.

13. The roof curb structure of claim 1 further comprising insulation material extending around the inner periphery of said shell between inturned top flanges on said shell and inner portions of said bottom strips and retained therebetween by vertically aligned downturned and upturned lips on inner edges of said inturned top flanges and said inner portions of said bottom strips, respectively.

14. The roof curb structure of claim 1 wherein said sides have inturned top flanges, and wood nailers are attached to top surfaces of said inturned top flanges around the entire periphery of said shell.

15. A roof curb structure for mounting a ventilator on a roof penetration of a building comprising a one piece, box-like sheet metal shell having four continuous sides interconnected together by three continuous corners and one seam welded corner, said sides having outturned bottom flanges and inturned top flanges, said inturned top flanges having beveled ends in abutting engagement with the beveled ends of adjacent inturned top flanges.

16. A roof curb structure for mounting a ventilator on a roof penetration of a building comprising a shell having a generally box-like shape, said shell being formed from two separate pieces of sheet metal each having two continuous sides interconnected by continuous right angle corners, said separate pieces of sheet metal having opposite ends joined together at two seam welded corners, said sides having outturned bottom flanges and inturned top flanges, said inturned top flanges having beveled ends in abutting engagement with the beveled ends of adjacent inturned top flanges.

17. A method of making roof curb structures for supporting ventilators on roofs of buildings comprising the steps of:

(a) cutting a series of transversely aligned V-shaped notches and straight slots along top and bottom edges of a continuous length of sheet metal strip material at spaced apart intervals corresponding to the length of each side of box-like shells to be formed from the strip material, (b) transversely severing the strip material at every fourth aligned notch and slot, (c) roll forming the top and bottom edges of each severed length of strip material in opposite directions at the full depth of the notches and slots to form oppositely extending top and bottom flanges along such top and bottom edges, (d) forming each severed length of strip material at each transversely aligned notch and slot intermediate the ends of each severed length of strip material in the direction of the top flanges to bring the edges of the intermediate notches into abutting engagement with each other to form three continuous right angle corners and bring the ends of each severed length of strip material into engagement with each other to form one non-continuous right angle corner, and (e) seam welding the non-continuous corner of each severed length of strip material to form a box-like shell for such roof curb structures having four sides with inturned top flanges along the top edges, and outturned bottom flanges along the bottom edges.

18. The method of claim 17 further comprising the steps of attaching the outturned bottom flanges of each shell to outer portions of four identical sheet metal bottom strips to form a bottom support for each shell, the bottom strips each having inner portions extending inwardly of the sides of each shell in vertically spaced relation to the inturned top flanges of each shell.

19. The method of claim 18 wherein the bottom strips extend a substantial portion of the length of the outturned bottom flanges and beyond one end of the outturned bottom flanges into underlying relation to an end of the next adjacent outturned bottom flange, the outturned bottom flanges and the end of the next adjacent bottom flange being spot welded to the same bottom strips.

20. The method of claim 18 further comprising the steps of forming downturned lips on the innermost edges of the top flanges and upturned lips on the innermost edges of the bottom strips of the same length as the downturned lips, and positioning the upturned lips on the bottom strips in substantial vertical alignment with the downturned lips on the innermost edges of the top flanges.

21. The method of claim 20 further comprising the step of placing insulation material around the inner periphery of each shell between the top flanges and inner portions of the bottom strips inwardly of the downturned and upturned lips.

22. The method of claim 21 further comprising the step of attaching wood nailers to the top flanges around the entire periphery of each shell.

23. The method of claim 20 further comprising the steps of fitting four identical damper tray strips within a box-like opening formed by the upturned lips on the bottom strips with one end of each damper tray strip pressed up against a respective upturned lip at each corner and the other end of each damper tray strip butting up against an inner edge of the next adjacent damper tray strip, and spot welding upturned lips on the outer edges of the damper tray strips to the upturned lips on the bottom strips.

24. A method of making roof curb structures for supporting ventilators on roofs of buildings comprising the steps of:

(a) cutting a series of transversely aligned V-shaped notches and straight slots along top and bottom edges of a continuous length of sheet metal strip material at spaced apart intervals corresponding to the length of each side of box-like shells to be made from the strip material, (b) transversely severing the strip material at every second aligned notch and slot, (c) roll forming the top and bottom edges of each severed length of strip material in opposite directions at the full depth of the notches and slots to form oppositely extending top and bottom flanges along the top and bottom edges, (d) forming each severed length of strip material at each transversely aligned intermediate notch and slot in the direction of the top flanges to bring the edges of the intermediate notch into abutting engagement with each other to form a continuous right angle corner in each folded length of strip material, (e) fitting the ends of two such folded lengths of strip material together to form two non-continuous right angle corners, and (f) seam welding such non-continuous corners together to form a box-like shell for such roof curb structures having two continuous right angle corners and two seam welded right angle corners.

* * * * *